US008690277B2

(12) United States Patent
Su

(10) Patent No.: US 8,690,277 B2
(45) Date of Patent: Apr. 8, 2014

(54) PRINTER

(75) Inventor: Liang-Ching Su, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 57 days.

(21) Appl. No.: 13/526,523

(22) Filed: Jun. 19, 2012

(65) Prior Publication Data

US 2013/0321518 A1 Dec. 5, 2013

(30) Foreign Application Priority Data

May 30, 2012 (TW) ..... 101119415 A

(51) Int. Cl.
*B41J 25/308* (2006.01)

(52) U.S. Cl.
USPC ..... 347/8; 347/37

(58) Field of Classification Search
USPC ..... 347/8, 37, 41; 400/59, 55
See application file for complete search history.

(56) References Cited

U.S. PATENT DOCUMENTS

2010/0328372 A1* 12/2010 Chuang ..... 347/8

* cited by examiner

*Primary Examiner* — Henok Legesse
(74) *Attorney, Agent, or Firm* — Novak Druce Connolly Bove + Quigg LLP

(57) ABSTRACT

A printer includes a top plate, a stabilizer bar, a screw, and a positioning member. The top plate is adapted for a piece of paper located thereon and defines a locking hole. The stabilizer bar is slidably attached to the top plate and defines a through hole and a step-shaped hole. The screw is screwed into the locking hole from the through hole. The positioning member includes a threaded portion. The threaded portion is mounted in the step-shaped hole. A part of the threaded portion extends out of the step-shaped hole, and the part of the threaded portion abuts the top plate.

19 Claims, 5 Drawing Sheets

PRINTER

BACKGROUND

1. Technical Field

The present disclosure relates to printers, and particularly a inkjet printer.

2. Description of Related Art

Many inkjet printers include a print head, a stabilizer bar, and a bracket. The print head is slidably attached to the stabilizer bar and includes a jet. A piece of paper is slid on a top plate of the bracket from a roller. The print head is slid along the stabilizer bar and ink sprays from the jet to print on the piece of paper. The printer must maintain a certain distance between the jet and the piece of paper to ensure the quality of printing. However, the stabilizer bar is secured to the top plate by screws threaded into a locking of the top plate from a through hole of the stabilizer bar, which may make the distance between the jet and the piece of paper smaller and affect the quality of printing. Therefore, an improved inkjet printer may be desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
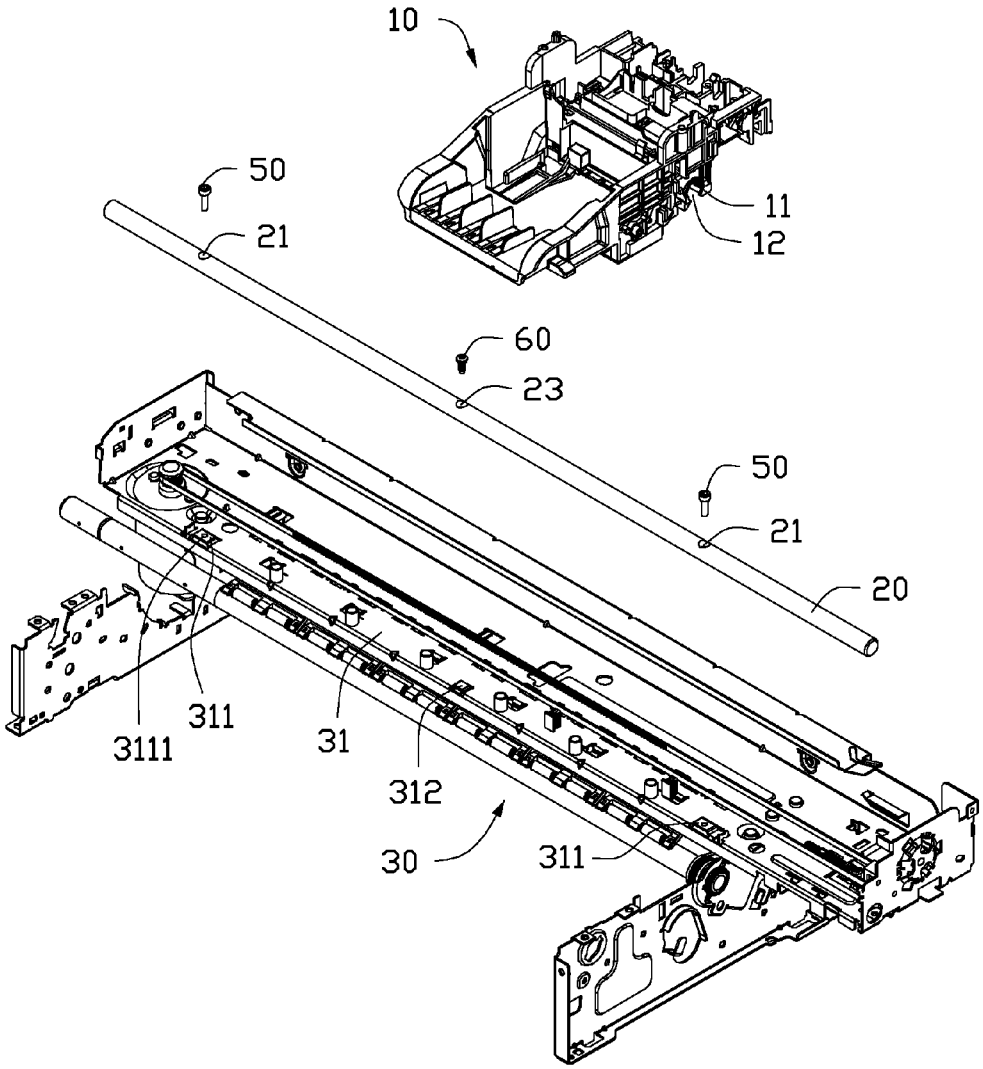
FIG. 1 is an exploded, isometric view of one embodiment of a printer.
Figure 2:
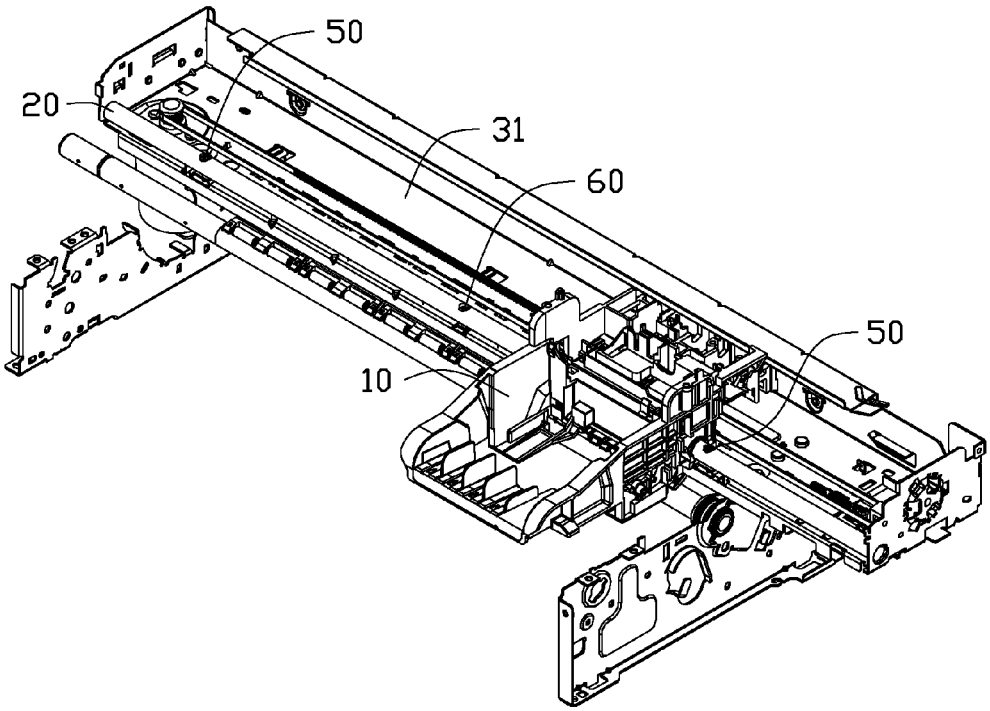
FIG. 2 is an assembled, isometric view of the printer of FIG. 1.
Figure 3:
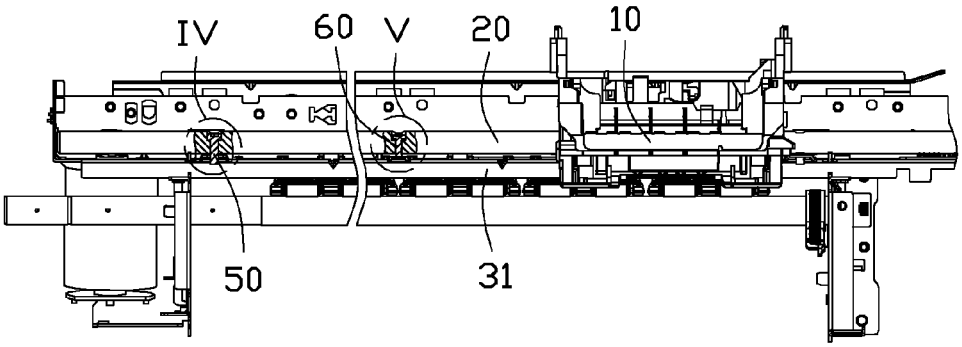
FIG. 3 is another assembled, isometric view of the printer of FIG. 1, and with a partially cutaway view of the printer of FIG. 1.
Figure 4:
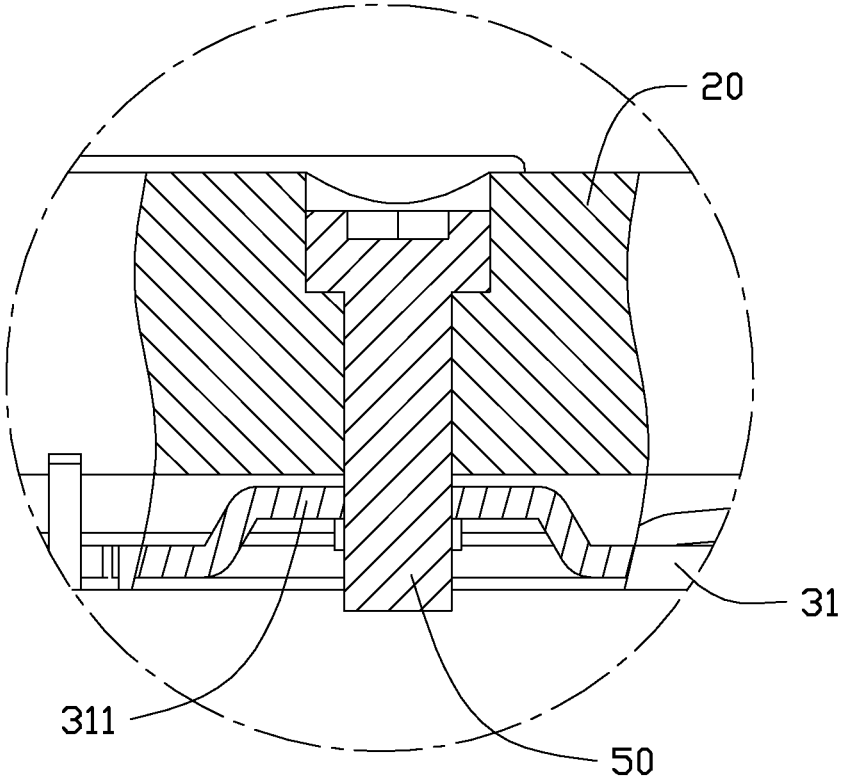
FIG. 4 is an enlarged view of a circled portion IV of FIG. 3.

FIG. 1 shows a printer in accordance with an embodiment including a print head 10, a stabilizer bar 20, and a bracket 30.

The print head 10 includes a jet (not shown) and defines a mounting hole 11. The mounting hole 11 has a cutout 12.

Figure 5:
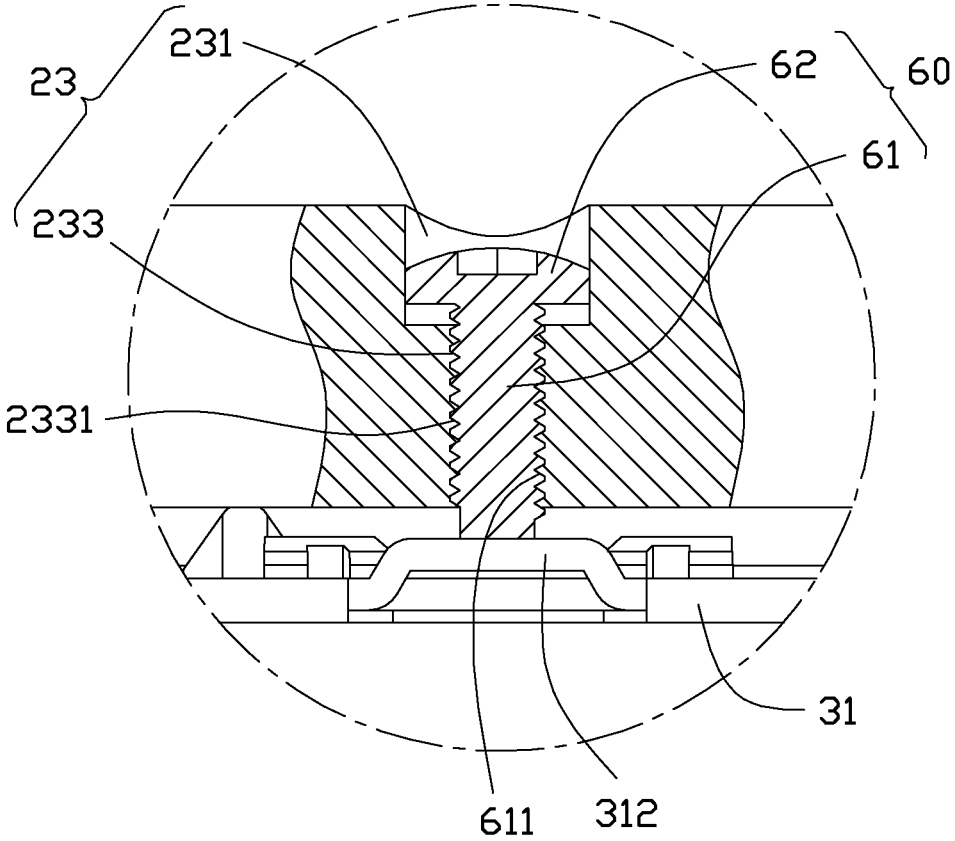
FIG. 5 is an enlarged view of a circled portion V of FIG. 3.

The stabilizer bar 20 is cylindrical. The stabilizer bar 20 defines two through holes 21 and a step-shaped hole 23. The step-shaped hole 23 is located between the two through holes 21. Referring to FIG. 5, the step-shaped hole 23 includes a receiving hole 231 and a securing hole 233. In one embodiment, the receiving hole 231 and the securing hole 233 are circular. A diameter of the receiving hole 231 is greater than a diameter of the securing hole 233. A plurality of inner threads 2331 is located in an inner surface of the securing hole 233.

The bracket 30 includes a top plate 31 for maintaining a piece of paper. Two locking pieces 311 and a restricting piece 312 extend upwards from the top plate 31. The restricting piece 312 is located between the two locking pieces 311. In one embodiment, the two locking pieces 311 and the restricting piece 312 are substantially parallel to the top plate 31. Each of the two locking pieces 311 defines a locking hole 3111.

The printer further includes two screws 50 and a positioning member 60. The positioning member 60 includes a threaded portion 61 and head portion 62. The threaded portion 61 includes a plurality of outer threads 611 corresponding to the plurality of inner threads 2331. In one embodiment, a cross section of the threaded portion 61 and the head portion 62 is circular. A diameter of the head portion 62 is greater than a diameter of the threaded portion 61. A height of the threaded portion 61 is greater than a height of the securing hole 233. In one embodiment, the positioning portion 60 is another screw.

FIGS. 2-5 show the stabilizer bar placed above the top plate 31, each of the two through holes 21 is aligned with each of the two locking holes 3111, and the securing hole 233 is aligned with the restricting piece 312. The positioning member 60 is moved to align the threaded portion 61 to the securing hole 233. The threaded portion 61 is threaded into the securing hole 233, until a part of the threaded portion 61 extends out of the securing hole 233 and abuts the restricting piece 312. In this position, the head portion 62 is received in the receiving hole 231, and a distance between the restricting piece 312 and the top plate 31 plus a height of the part of the threaded portion 61 are equal to a distance between the jet and the top plate 31. Each of the two screws 50 is threaded into each of the two locking holes 3111 through each of the two through holes 21, to secure the stabilizer bar 20 to the top plate 31. During the process, the positioning member 60 prevents the distance between the jet and the top plate 31 from changing.

When the distance between the jet and the top plate 31 needs to be adjusted, the positioning member 60 is rotated in the securing hole 233 and the height of the part of the threaded portion 61 extending out of the securing hole 233 is adjusted.

In use, the print head 10 engages the stabilizer bar 20 in the mounting hole 11. The print head 10 is slidable along the stabilizer bar 20, and ink sprays from the jet to print on a piece of paper on the top plate 31.

In another embodiment, both the locking piece 311 and the restricting piece 312 are not located on the top plate 31. Instead, the locking hole 3111 is defined directly in the top plate 31, the screw 50 is threaded into the stabilizer bar 20 and the top plate 31, and the threaded portion 61 abuts the top plate 31 directly.

It is to be understood, however, that even though numerous characteristics and advantages have been set forth in the foregoing description of embodiments, together with details of the structures and functions of the embodiments, the disclosure is illustrative only and changes ay be made in detail, especially in the matters of shape, size, and arrangement of parts within the principles of the disclosure, to the full extent indicated by the broad general meaning of the terms in which the appended claims are expressed.

What is claimed is:

1. A printer comprising:

a bracket comprising a top plate defining a locking hole;

a stabilizer bar slidably attached to the top plate and defining a through hole, a step-shaped hole, and a plurality of inner threads on an inner surface of the step-shaped hole;

a screw engaged in the locking hole from the through hole; and a positioning member comprising a threaded portion;

wherein the threaded portion comprises a plurality of outer threads mounted in the step-shaped hole and is rotatable along the plurality of inner threads; a part of the threaded portion extends out of the step-shaped hole and abuts the top plate.

2. The printer of claim 1, wherein the bracket further comprises a restricting piece extending from the top plate, and the threaded portion abuts the restricting piece.

3. The printer of claim 2, wherein the restricting piece is substantially parallel to the top plate.

4. The printer of claim 2, wherein the stabilizer bar is substantially parallel to the top plate, and a height of the part of the threaded portion extending out of the step-shaped hole plus a distance between the restricting piece and the top plate are equal to a distance between the print head and the top plate.

5. The printer of claim 1, wherein the bracket further comprises a locking piece extending from the top plate, the locking piece is substantially parallel to the top plate, and the locking hole is defined in the locking piece.

6. The printer of claim 1, wherein the step-shaped hole comprises a receiving hole and a securing hole; the positioning member further comprises a head portion connected to the threaded portion; the head portion is received in the receiving hole, and the threaded portion is rotatably received in the securing hole.

7. The printer of claim 6, wherein a height of the threaded portion is greater than a height of the secured hole.

8. The printer of claim 6, wherein a cross section of the positioning member is circular, and a diameter of the head portion is greater than a diameter of the threaded portion.

9. The printer of claim 1, wherein the positioning member is another screw.

10. A printer comprising:

a bracket comprising a top plate defining a locking hole;

a stabilizer bar slidably attached to the top plate and defining a through hole and a step-shaped hole;

a screw engaged in the locking hole from the through hole; and a positioning member comprising a threaded portion;

wherein the threaded portion is mounted in the step-shaped hole; a part of the threaded portion extends out of the step-shaped hole and abuts the top plate.

11. The printer of claim 10, wherein a plurality of inner threads are located on an inner surface of the step-shaped hole; the threaded portion comprises a plurality of outer threads; and the threaded portion is rotatable along the plurality of inner threads.

12. The printer of claim 10, wherein the bracket further comprises a restricting piece extending from the top plate, and the threaded portion abuts the restricting piece.

13. The printer of claim 12, wherein the restricting piece is substantially parallel to the top plate.

14. The printer of claim 12, wherein the stabilizer bar is substantially parallel to the top plate, and a height of the part of the threaded portion extending out of the step-shaped hole plus a distance between the restricting piece and the top plate are equal to a distance between the print head and the top plate.

15. The printer of claim 10, wherein the bracket further comprises a locking piece extending from the top plate, the locking piece is substantially parallel to the top plate, and the locking hole is defined in the locking piece.

16. The printer of claim 10, wherein the step-shaped hole comprises a receiving hole and a securing hole; the positioning member further comprises a head portion connected to the threaded portion; the head portion is received in the receiving hole, and the threaded portion is rotatably received in the securing hole.

17. The printer of claim 16, wherein a height of the threaded portion is greater than a height of the secured hole.

18. The printer of claim 16, wherein a cross section of the positioning member is circular, and a diameter of the head portion is greater than a diameter of the threaded portion.

19. The printer of claim 10, wherein the positioning member is another screw.

* * * * *